United States Patent [19]

Sauder, Jr. et al.

[11] Patent Number: 4,742,650

[45] Date of Patent: May 10, 1988

[54] SANDING MACHINE

[75] Inventors: H. Richard Sauder, Jr., Narvon; Norman L. Hahn, New Holland, both of Pa.

[73] Assignee: Conestoga Wood Specialities, Inc., East Earl, Pa.

[21] Appl. No.: 928,906

[22] Filed: Nov. 7, 1986

[51] Int. Cl.[4] ..... B24B 21/04

[52] U.S. Cl. ..... 51/138; 51/142

[58] Field of Search ..... 51/137, 138, 139, 141, 51/142

[56] References Cited

U.S. PATENT DOCUMENTS

| | | | |
|---|---|---|---|
| 275,385 | 4/1883 | Howe . | |
| 1,212,214 | 4/1917 | Halterbeck . | |
| 1,247,152 | 11/1917 | Roberts | 51/119 |
| 1,909,902 | 5/1933 | Amsler | 51/119 |
| 1,935,660 | 11/1933 | Norton | 51/138 |
| 2,187,131 | 1/1940 | Lippold | 51/139 |
| 2,714,787 | 8/1955 | Orr | 51/142 |
| 2,739,426 | 3/1956 | Kinker | 51/138 |
| 2,775,853 | 1/1957 | Jones . | |
| 3,079,734 | 3/1963 | Eschenburg . | |
| 3,094,815 | 6/1963 | Pendergast | 51/142 |
| 3,178,860 | 4/1965 | Clyne | 51/140 |
| 3,543,443 | 12/1970 | Heesemann | 51/137 |
| 3,621,615 | 11/1971 | Ottinger . | |
| 3,654,738 | 4/1972 | Sternal . | |
| 3,832,807 | 9/1974 | Kiser et al. . | |
| 3,872,627 | 3/1975 | Schuster . | |
| 4,478,010 | 10/1984 | Dicke . | |

*Primary Examiner*—Harold D. Whitehead
*Attorney, Agent, or Firm*—Larry W. Miller

[57] ABSTRACT

A sanding machine for sanding the surfaces of work pieces placed upon a conveyor operable to transport the work pieces along a first direction is disclosed wherein each of two sanding heads is oscillated at two different frequencies relative to the work pieces on the conveyor. The first oscillating frequency orbits the sanding heads in a circular motion over the work pieces on the conveyor, while the second oscillating frequency, which is greater than the first frequency, results in a vibration of the individual sanding elements engaging the work pieces. Each sanding head includes a plurality of sander elements transversely spaced above the conveyor, the sander elements of the first sanding head being staggered with respect to the sander elements of the second sanding head. The orbiting sub-frames mounting the respective sets of sander elements are driven by crank mechanisms cantilevered by one end thereof being affixed to the main frame, while the opposing end is engageable with a movable support hingedly connected to the main frame to facilitate a removal of the sanding belts forming a part of each sander element.

20 Claims, 8 Drawing Sheets

10
13
40
12
48
42
47
43
45
46
36
24
71
29
31
32
28
72
6
49
49
69
68
69
52
62
51
24
66
38
54
42
44
44
55
16
65
6
64

SANDING MACHINE

BACKGROUND OF THE INVENTION

This invention relates generally to machines constructed for abrading material and, more particularly, to an improved sanding machine for placing a finished surface on wooden work pieces.

Mechanized sanding machines have been provided to sand the upper and or lower surface of wooden work pieces being conveyed along a movable conveyor forming the work table of the sanding machine. These machines, such as found in U.S. Pat. No. 3,832,807, will typically utilize a wide sanding belt entrained around vertically spaced rollers. Such machines will often leave cross grain scratch patterns in the sanded surface of the wooden work piece, resulting in an unattractive and unacceptable finish in the work piece. A further problem relates to a movement of the work piece induced by the rotational movement of the sanding head.

Mechanized hand sanders, such as shown in U.S. Pat. No. 4,478,010, can provide an acceptable finish on the wooden work piece; however, such sanding operations are highly labor intensive and, therefore, expensive. It would be desirable to provide a mechanized sanding machine operable to sand the upper surface of wooden work pieces placed upon a conveyor that would emulate the sanding operation of a mechanized hand sander.

SUMMARY OF THE INVENTION

It is an object of this invention to overcome the aforementioned disadvantages of the prior by providing a sanding machine having sanding heads operable to oscillate at two different frequencies relative to the work piece being conveyed on a conveyor.

It is another object of this invention to provide a sanding machine having first and second oscillating mechanisms to emulate the sanding operation of a mechanized hand sander.

It is an advantage of this invention that a fine finish can be placed upon a wooden work piece by mechanized sanding machine without the necessity of utilizing hand labor.

It is another advantage of this invention that a fine finish can be placed upon a wooden work piece by a mechanized machine utilizing a coarser sandpaper than previously known in the art to provide a similar finish.

It is still another object of this invention to provide a sanding head comprising a plurality of spaced apart sander elements having individual sanding belts rotatably mounted thereon to engage the work pieces on the movable conveyor positioned immediately therebeneath.

It is a feature of this invention that the amplitude of the orbiting motion induced into the sanding heads by the first oscillating mechanism is greater than the distance between the individual sander elements.

It is another feature of this invention that the first oscillating mechanism is partially supported by a removable support member hingedly connected to the main frame.

It is another advantage of this invention that the movable support member facilitates the removal and replacement of individual sanding belts on the sander elements.

It is still another feature of this invention that the spacing of the sander elements on the first sanding head of the sanding machine is staggered with respect to the spacing, of the sander elements on the second sanding head.

It is yet another object of this invention to vibrate the individual sanding belts during the sanding operation of the sanding machine.

It is yet another feature of this invention that a dampening mechanism is engaged with the individual sanding belts to reduce the noise caused by the vibration in the belts above the work piece being sanded.

It is yet another object of this invention to minimize the time of contact of the sanding paper with the workpiece.

It is still another feature of this invention that the timing of the vibratory motion of the individual sanding elements is timed so that adjacent sanding elements oppose each other to effect a removal of material from the work piece instead of an overall movement of the workpiece.

It is yet a further advantage of this invention that a satisfactory finish can be placed on a wooden work piece with only one pass through a mechanized sanding machine.

It is yet another feature of this invention that the conveyor is vertically adjustable relative to the sanding heads to accomodate work pieces having different thicknesses.

It is yet a further object of this invention to provide a mechanized sanding machine, which is durable in construction, inexpensive of manufacture, carefree of maintenance, facile in assemblage, and simple and effective in use.

These and other objects, features and advantages are accomplished according to the instant invention by providing a sanding machine for sanding the surfaces of work pieces placed 20. upon a conveyor operable to transport the work pieces along a first direction wherein each of two sanding heads is oscillated at two different frequencies relative to the work pieces on the conveyor. The first oscillating frequency orbits the sanding heads in a circular motion over the work pieces on the conveyor, while the second oscillating frequency, which is greater than the first frequency, results in a vibration of the individual sanding elements engaging the work pieces. Each sanding head includes a plurality of sander elements transversely spaced above the conveyor, the sander elements of the first sanding head being staggered with respect to the sander elements of the second sanding head. The orbiting sub-frames mounting the respective sets of sander elements are driven by crank mechanisms cantilevered by one end thereof being affixed to the main frame, while the opposing end is engageable with a movable support hingedly connected to the main frame to facilitate a removal of the sanding belts forming a part of each sander element.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
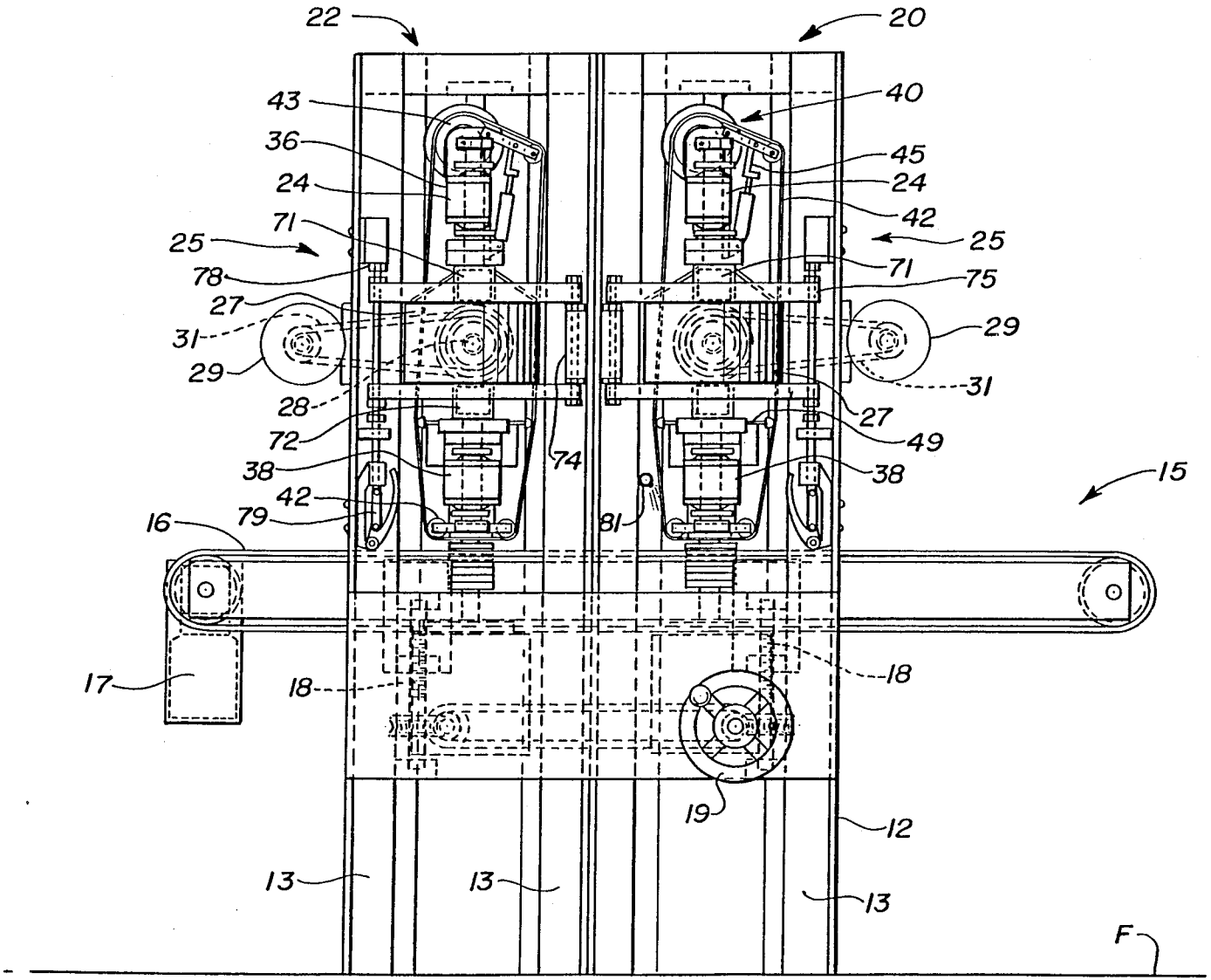
FIG. 1 is a left side elevational view of the sanding machine incorporating the principles of the instant invention, the movement of the work piece upon the conveyor being in the direction of right to left.
Figure 2:
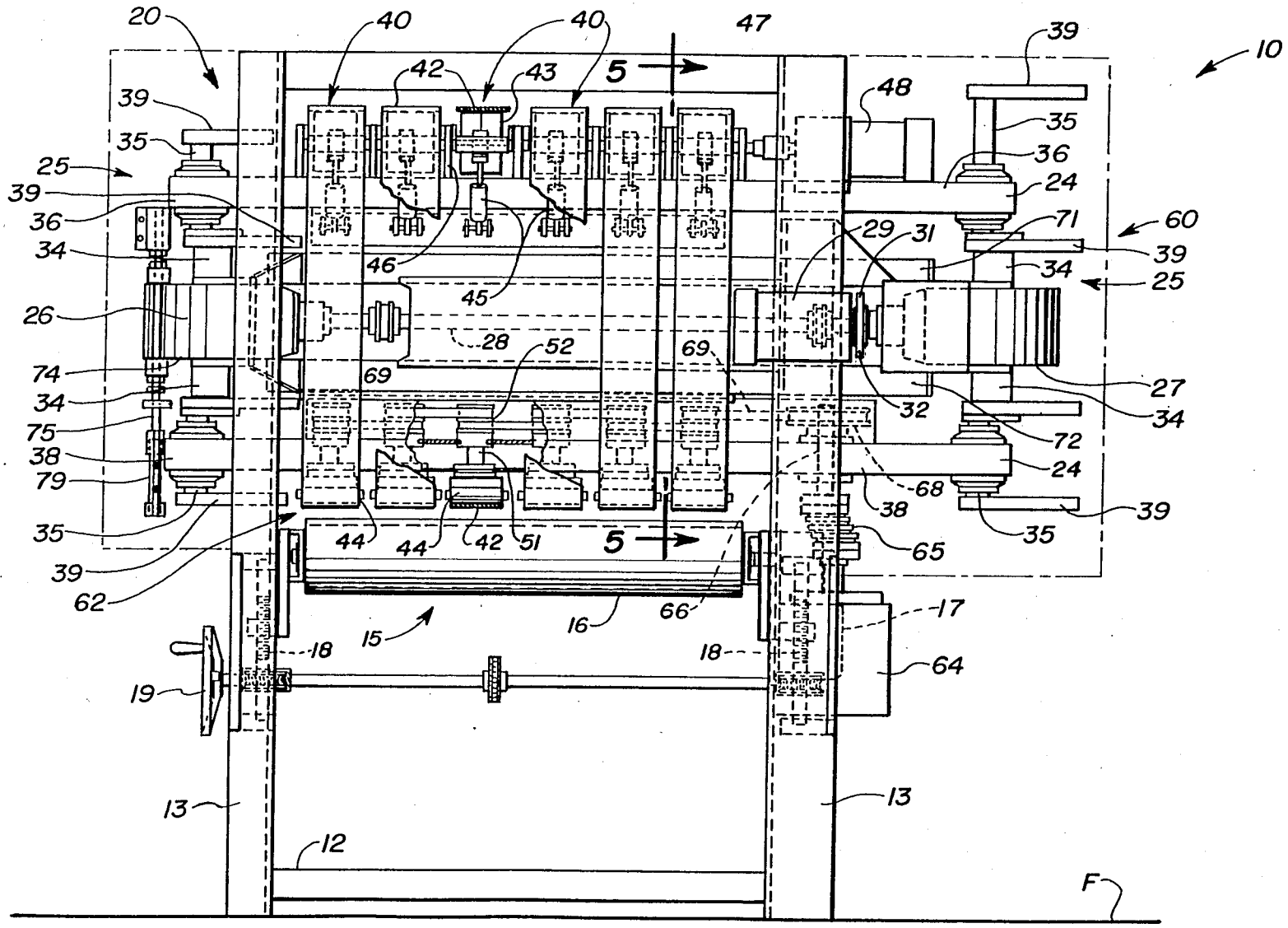
FIG. 2 is a front elevational view of the sanding machine shown in FIG. 1, portions of the sander elements being broken away to better show the details of the machine, the shielding being depicted by broken lines around the exterior of the machine.

Referring now to the drawings and, particularly, to FIGS. 1–4, a mechanized sanding machine 10 incorporating the principles of the instant invention can be seen. Any left and right references are used as a matter of convenience and are determined by standing at the front or input side of the machine, i.e., the view of FIG. 2, such that the conveyor 15 will transport work pieces placed thereon into the machine 10.

The sanding machine 10 includes a stationary main frame 12 having a series of generally vertically extending angle members forming legs 13 which support the sander 10 above the floor F. The frame 12 supports above the floor F a generally horizontal work table 15 in the form of conveyor 16 which is driven by an electric motor 17 and operable to transport work pieces W, representatively shown in FIGS. 3 and 4, through the machine 10 for a sanding operation. The conveyor 16 is provided with screw type height adjusting members 18 which can be actuated by the wheel 19 to raise and lower the conveyor 16 relative to the sanding heads 20,22 in a conventional manner to accommodate work pieces with different thicknesses.

Figure 4:
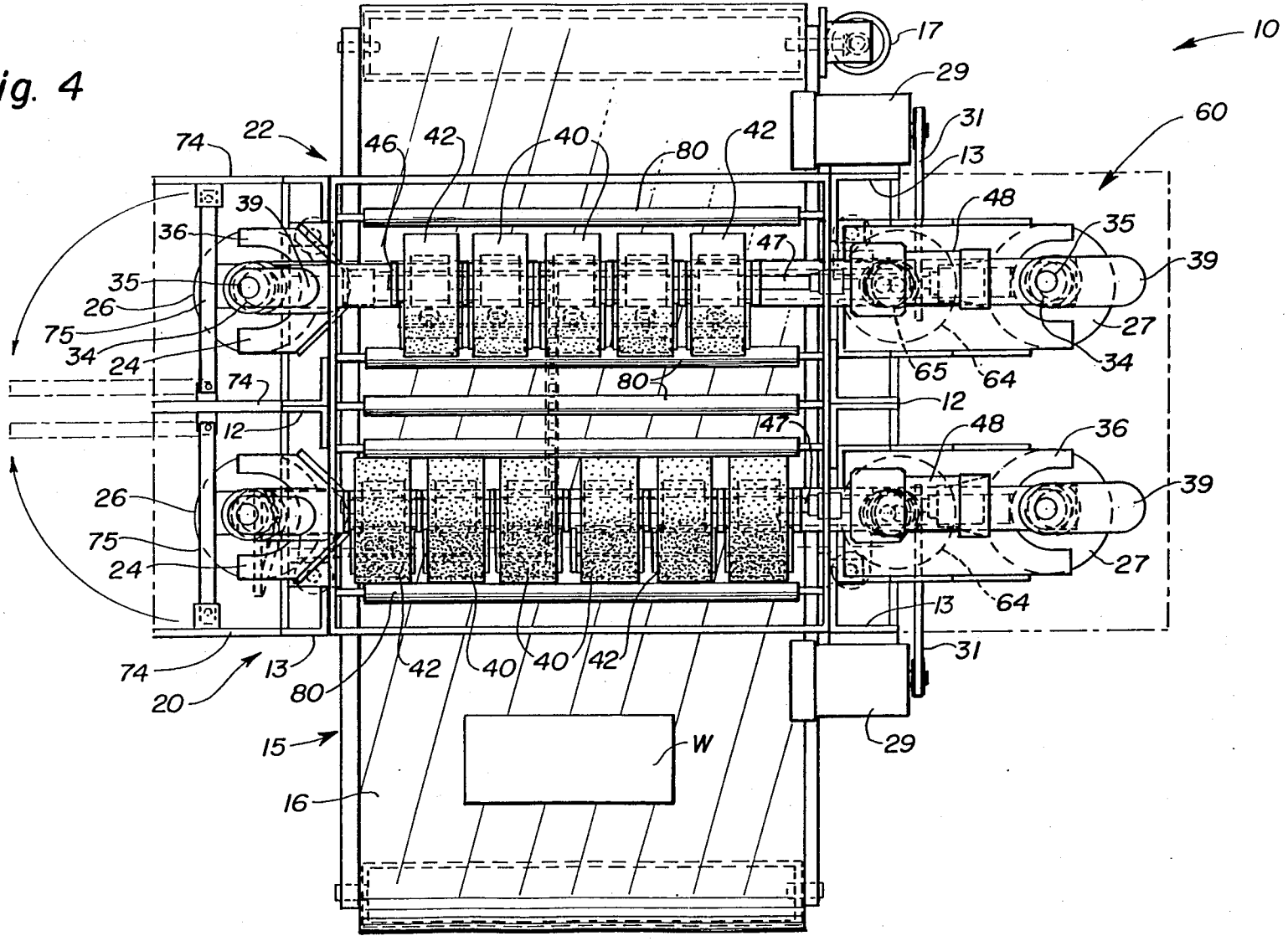
FIG. 4 is a top plan view of the sanding machine shown in FIG. 3, the movement of the removable support members hingedly mounted on the main frame being shown in phantom.

The sanding machine is preferably constructed as a double headed machine having a first sanding head 20 positioned forwardly of a second sanding head 22, as seen from the perspective of the work pieces W being fed through the machine 10 by the conveyor 16. Each of the sanding heads 20,22 is similarly constructed, except for the number and particular arrangement of the sander elements which, as best seen in FIG. 4, are arranged in a staggered relationship as will be described in greater detail below. Accordingly, the description of the construction of the first sanding head 20 will be construed as being applicable to both the sanding heads 20,22.

The sanding head 20 includes a sub-frame 24 connectable to a crank mechanism 25 to affect a reciprocable movement of the sanding head 20 in a circular pattern including a component extending transversely of the conveyor belt 16. The crank mechanism 25 is preferably constructed with a pair of gearboxes 26,27 disposed along the left and right sides, respectively, of the machine 10 and connected by a shaft 28. The shaft 28 is driven by an electric motor 29 and belt drive 31 interconnecting the motor 29 and a sheave 32 on the shaft 28. Extending generally vertically out of each respective gearbox 26,27 is a driven shaft 34 to which crank shafts 35 are eccentrically connected such that a rotation of the driven shaft 34 creates an orbiting of the crank shafts 35. The sub-frame 24 is comprised of an upper member 36 and a spaced apart lower member 38 interconnecting corresponding transversely spaced crank shafts 35 to form a sub-frame assembly operable to orbit in a circular motion relative to the main frame 12 upon a driving rotation of the connecting shaft 28. A series of counter weights 39 mounted on the crank shafts 35 counterbalance the offset mass of the sanding heads 20,22 being orbited by the crank mechanism 25.

The sanding head 20 further includes a plurality of transversely spaced sander elements 40 mounted on the sub-frame 24 for reciprocation therewith. As best seen in FIGS. 1–5, each sander element 40 includes an endless sanding belt 42 entrained around an upper roller 43 and a pair of fore-and-aft spaced lower rollers 44. A conventional pneumatic belt tensioning mechanism 45 is provided adjacent the upper roller 43 to maintain proper tension within the sanding belt 42. Each upper roller 43 is mounted on a transverse drive shaft 47 rotatably supported by brackets 46 connected to the upper sub-frame member 36. The drive shaft 47 is drivingly coupled to an electric motor 48 to effect a rotation of the sanding belts 42.

As best seen in FIGS. 5–8, the lower sub-frame member 38 rotatably mounts a vibratory drive shaft 51 having a double timing pulley sheave assembly 52 mounted on the upper portion thereof. The shaft 51 terminates below the lower sub-frame member 38 in an eccentrically mounted bearing 54 on which a sanding pad 55 is affixed. The sanding pad 55 includes a rectangular formed shoe 56 having upstanding ears 57 positioned at each respective corner thereof. Corresponding transversely spaced pairs of ears 57 support the rotatable mounting of the respective pair of lower rollers 44 to rotatably support the sanding belt 42 on either fore-and-aft side of the sanding pad 55. A counterweight 59 counterbalances the offset mass of the sanding pad 55 with respect to the axis of rotation of the vibrating drive shaft 51 to balance the driving rotation of the shaft 51. The sanding pad 55 is also provided with a sponge rubber portion 58 affixed to the lower side of the formed shoe 56 to form a cushion between the shoe 56 an the rotating sanding belt 42 and to transfer the vibration induced by the eccentrically mounted shoe 56 to the sanding belt 42 to improve the sanding action on the work piece. A stationary sealed dust cover 53 is connected to the bottom frame member 38 and terminates adjacent the shoe 56 to prevent the introduction of dust to the bearing 54 and to prevent the rotation of the shoe 56, while permitting the vibratory motion of the shoe 56.

While the crank mechanism 25 eccentrically mounting the sub-frame 24 for reciprocal movement thereof relative to the main frame 12 forms a first oscillating mechanism 60 for moving the sanding heads 20,22 relative to any work piece W being sanded on the work table 15, the eccentrically mounted sanding pad 55 on the vibrator drive shaft 51 forms a second oscillating mechanism 62 to move the sanding pads 55 relative to the work piece W independently of the oscillation induced by the first oscillating mechanism 60. The first oscillating frequency is a relatively low frequency of approximately 120 revolutions per minute with an amplitude approximately 2 inches, whereas the second oscillating frequency, i.e., the jitterbug vibration of the individual sanding belts 42, is significantly higher at about 7,000 revolutions per minute with an amplitude of about 0.1 inch.

Figure 3:
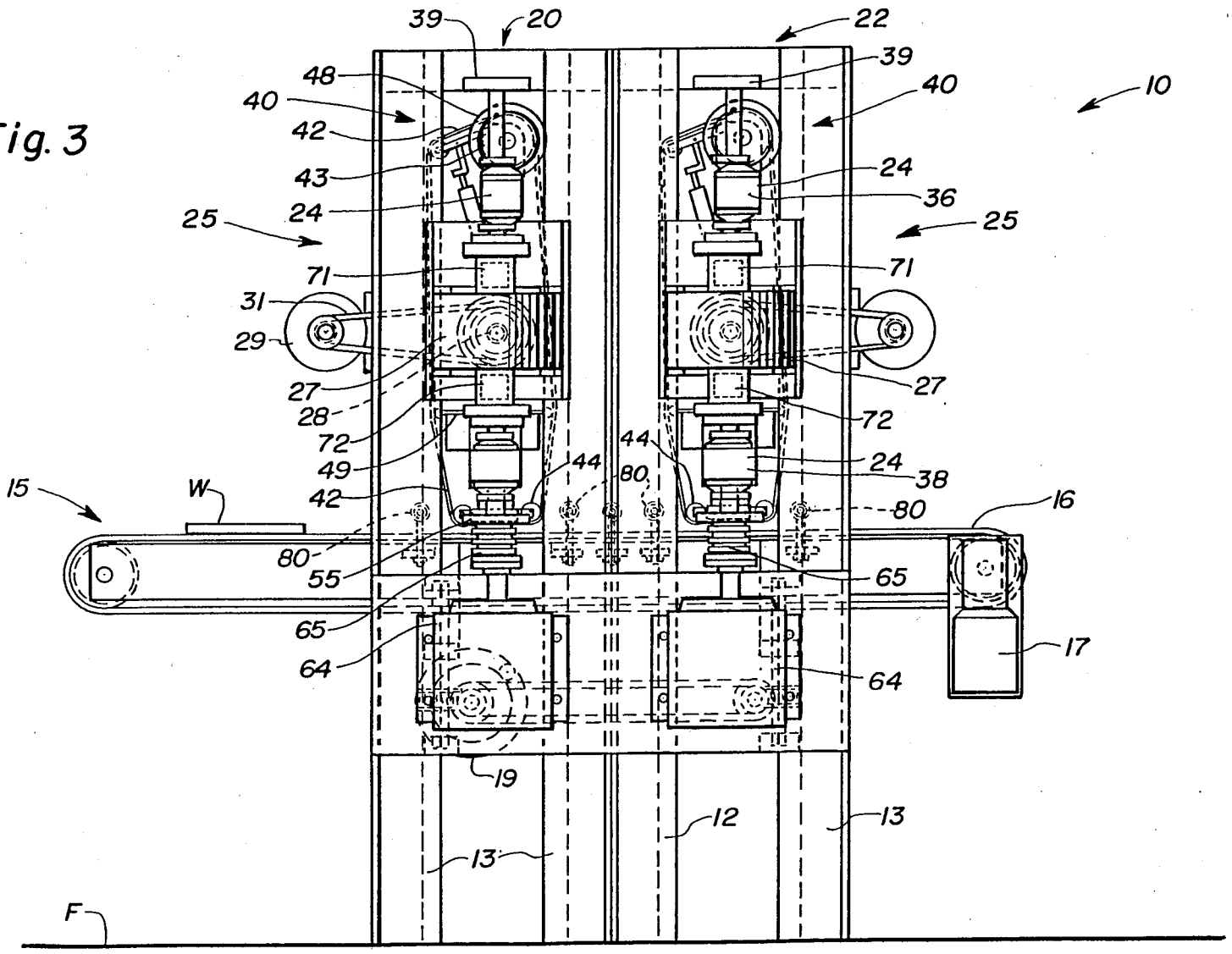
FIG. 3 is a right side elevational view of the sanding machine shown in FIGS. 1 and 2 with optional hold-down rollers being shown on opposing sides of each sanding head, a representive work piece being depicted on the conveyor to be fed into the sanding machine.
Figure 5:
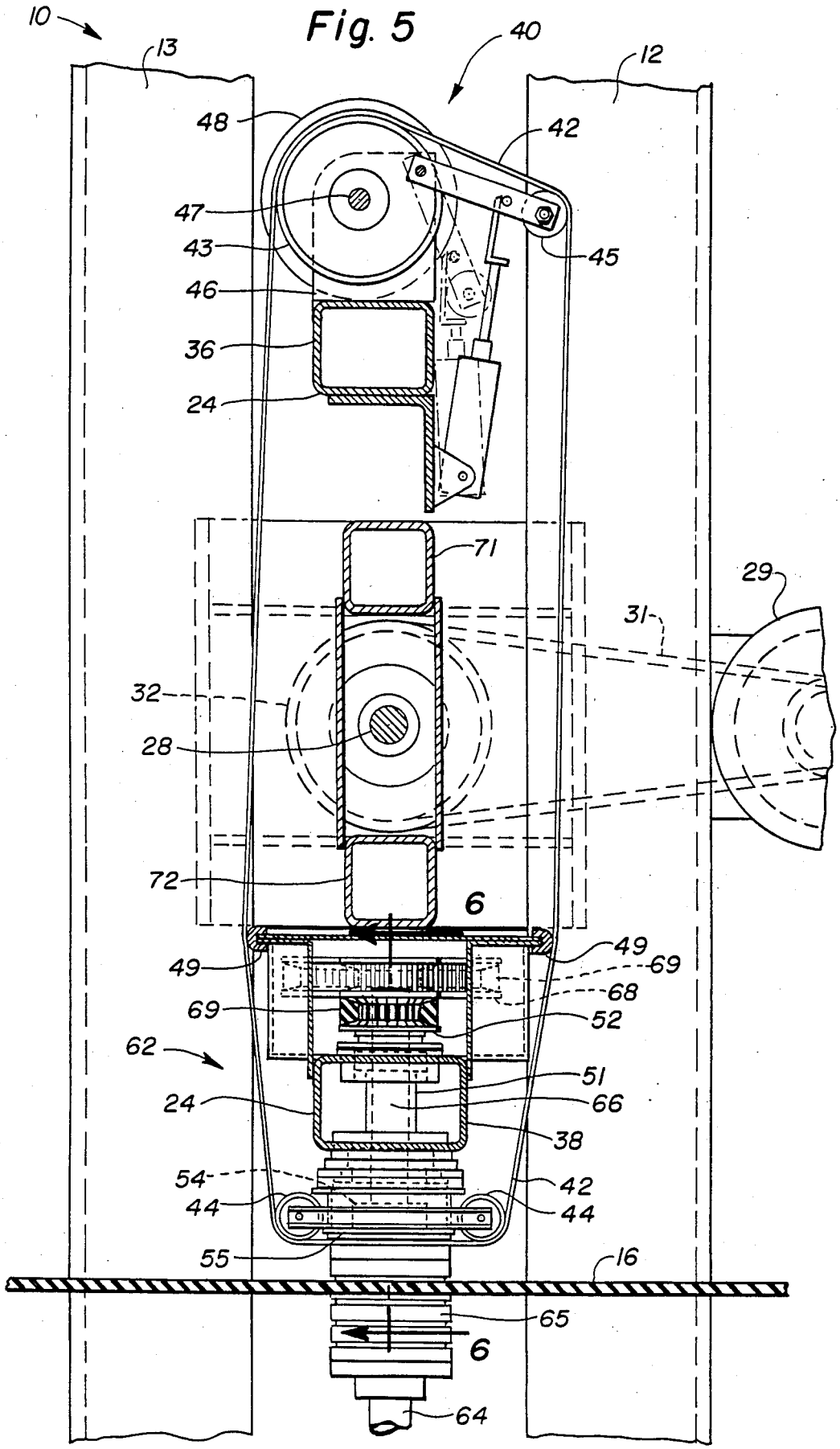
FIG. 5 is an enlarged partial cross-sectional view through the first sanding head taken along lines 5—5 of FIG. 2 to show a side elevational view of one of the sander elements, much of the crank mechanism and frame structure being removed for purposes of clarity.
Figure 6:
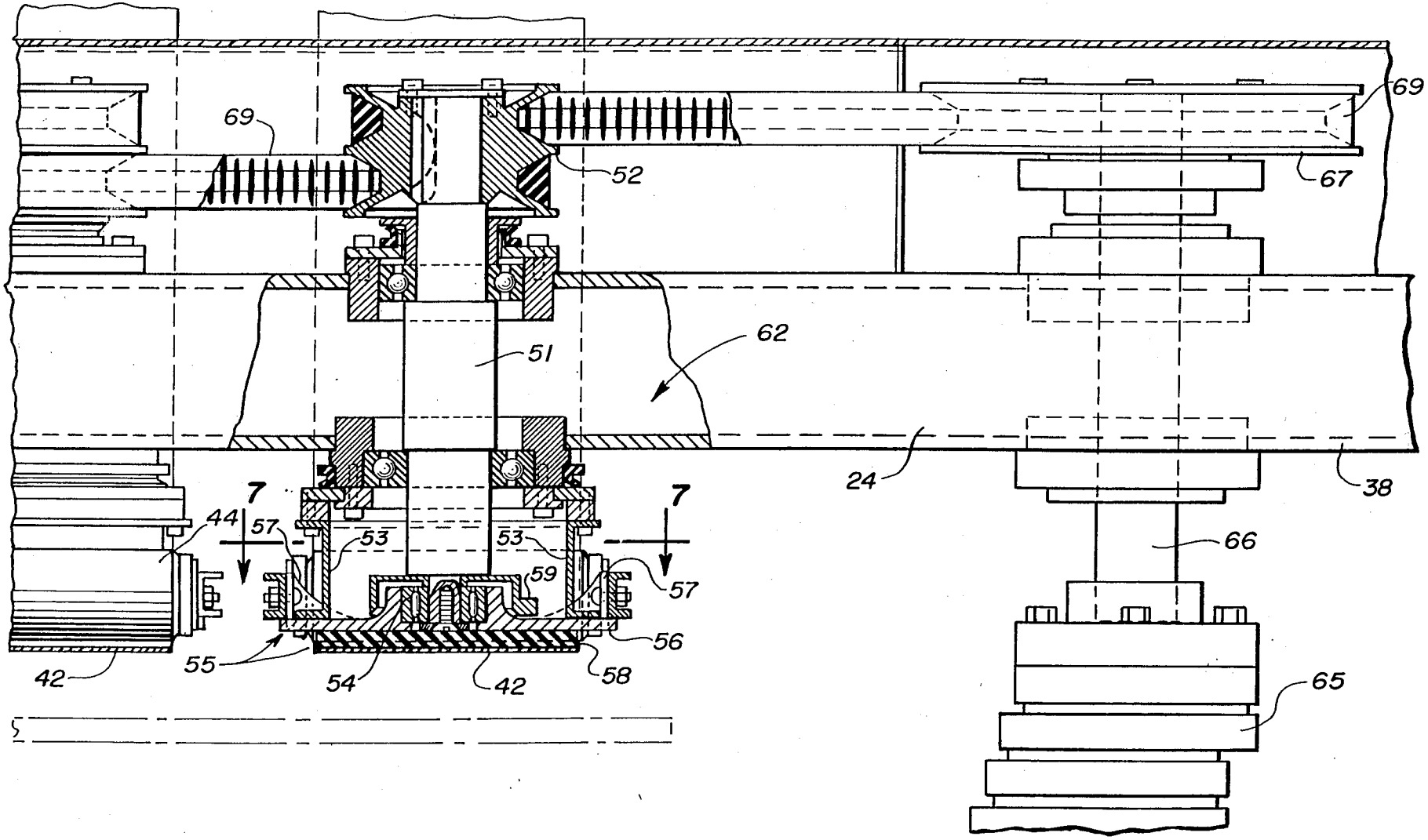
FIG. 6 is an enlarged partial cross-sectional view of the sander element taken along lines 6—6 of FIG. 5 to show the vibrating mechanism associated with each respective sander element, the adjoining drive mechanism and adjacent sander element being shown in elevation with the sanding belt being broken away, the relative location of the conveyor being shown in broken lines.

The individual vibrator drive shafts 51 are driven from an electric motor 64 stationarily mounted on the main frame 12 so as to reduce the mass being reciprocated on the sub-frame 24 and to avoid undue stresses on the electric motor 64. Because the sub-frame 24 and the sander elements 40 mounted thereon are being reciprocated by the first oscillating mechanism 60 relative to the electric motor 64, a special drive coupling 65 interconnects a jackshaft 66 rotatably mounted in the lower subframe member 38 adjacent the electric motor 64. An example of a drive coupling 65 that will accommodate the reciprocal movement of the jackshaft 66 relative to the stationary electric motor 64 is the Schmidt Model L200 offset coupling. A drive pulley 68 mounted on the jackshaft 66 is drivingly coupled to the adjacent double pulley assembly 52 by a drive belt 69. The rotational power is transferred between adjacent double sheave assemblies 52 by additional drive belts 69 entrained between corresponding portions of adjacent double sheave assemblies 52. The oscillating action of the shoe 56 is depicted schematically in FIG. 8 in a sequential manner from quadrant to quadrant, the respective positions of the corners of the shoe 56 and roller 43 mounted thereon depicting the limits of the oscillatory motion induced by the eccentricity of the shoe 56 mounted on the drive shaft 51. To reduce the vibrations emanating from the long spans of the sanding belts 42 stretching from the lower rollers 44 to the upper roller 43 on each sander element 40, a dampening mechanism 49 is provided adjacent each lower subframe member 38 to engage the sanding belt 42, which is best seen in FIGS. 1, 3 and 5. The dampening of the belts 42 reduces the operational noise of the machine 10 and increases belt life.

Referring again to FIGS. 1-4, the main frame 12 is also provided with stationary upper and lower frame members 71,72. These frame members 71,72 are affixed at the right side thereof to the legs 13 of the main frame 12 and extend toward the left side of the machine 10 in a cantilevered fashion. The respective gearboxes 26,27 are mounted between these horizontal frame members 71,72 to stationarily mount the gearboxes on the main frame 12. The left side of the main frame 12 is provided with a frame extension 74 on which a movable frame support 75 is hingedly secured. The frame support 75 is formed to snugly receive the left gearbox 26 between upper and lower members 76,77. The frame support 75 is engageable with a clamping mechanism 78 secured by an overcenter latch 79 to rigidly secure the frame support 75 into engagement with the left gearbox 26. In this manner, the horizontal frame members 71,72 and the crank mechanism 25 can be supported by the left side of the main frame 12. However, when it is desirable to remove the sanding belts 42 from the respective sander elements 40 on the sanding heads 20,22, the movable frame support 75 can be unlatched and swung about its hinge axis on the frame extension 74 to permit access to the sanding heads 20,22 for removal and replacement of the sanding belts 42 while the frame members 71,72 and crank mechanism 25 extends in a cantilevered manner from the right side of the main frame 12.

In operation, the operator places work pieces W on the upper surface of the conveyor 16 to be transported into engagement with the first sanding head 20. Optional hold-down rollers 80 may extend transversely of the conveyor belt 16 on fore-and-aft sides of each of the sanding heads 20,22, as best seen in FIGS. 3 and 4, and can be utilized to hold the work piece W against the conveyor belt 16 while the sanding heads 20,22 engage the upper surface of the work piece W for a sanding operation thereof. It has been found, however, that by phasing adjacent eccentrically mounted sanding pads 55 at 180° with respect to the oscillations therebetween while rotating all drive shafts 51 in the same direction, the hold-down rollers would not be necessary so long as the work piece W contacted at least two of the individual sander elements 40 while engaged with the respective sanding heads 20,22, i.e., the countervibrating sanding pads 55 will hold the work piece on the conveyor 16 without causing a shifting thereof while sanding its surface. Accordingly, maintenance of the phase differential between adjacent second oscillating mechanisms 62 would require the use of timing belts 69, such as representatively shown in FIGS. 5 and 6, extending between adjacent double timing pulley assemblies 52, thereby maintaining the offset phase relationships therebetween.

Figure 9:
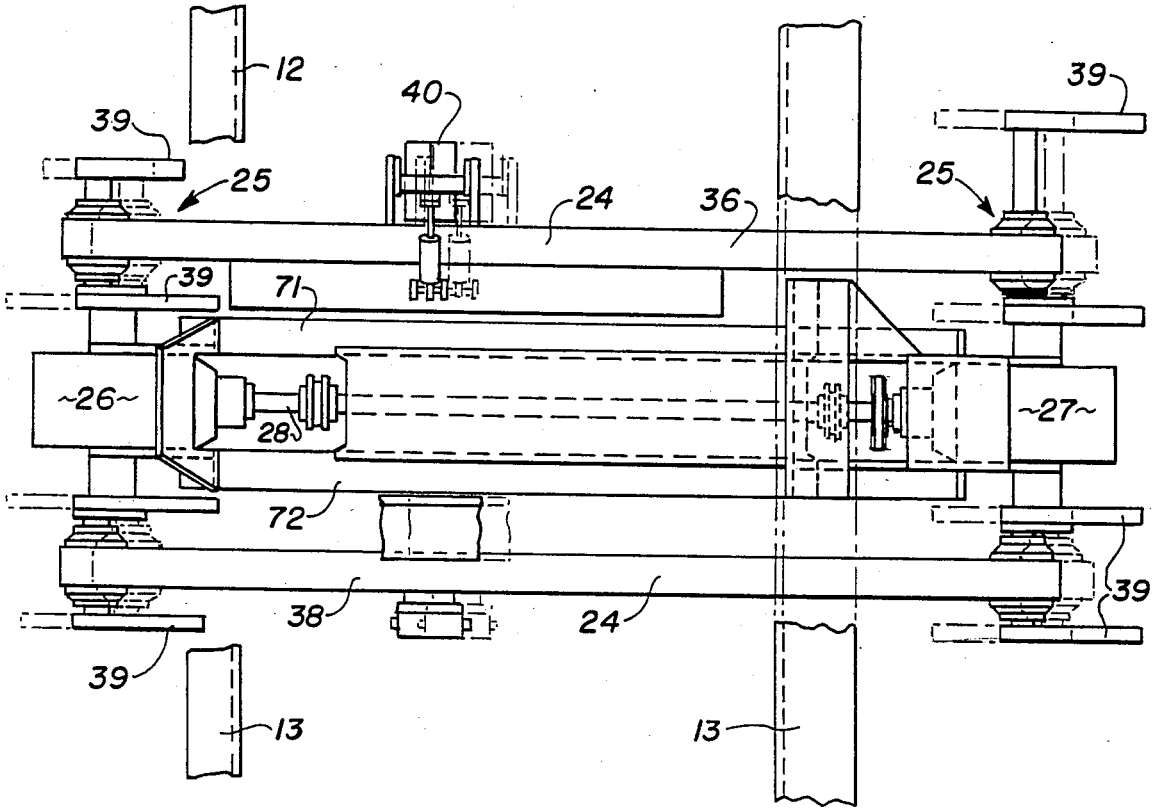
FIG. 9 is a schematic front elevational view of the sanding machine to depict the reciprocatory movement of the subframe from which the sanding heads are mounted relative to the main frame, the motion of a representative sander element and the crank mechanism being shown in phantom.
Figure 7:
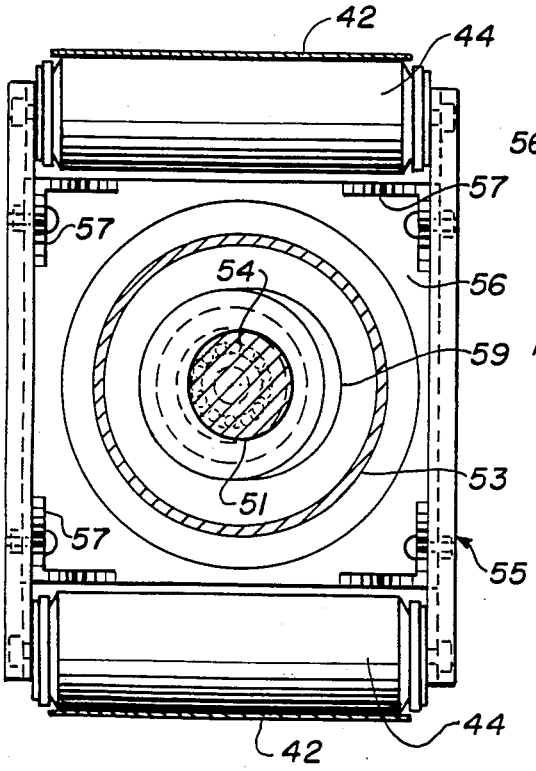
FIG. 7 is a cross-sectional view of the vibrating mechanism corresponding to lines 7—7 of FIG. 6.
Figure 8:
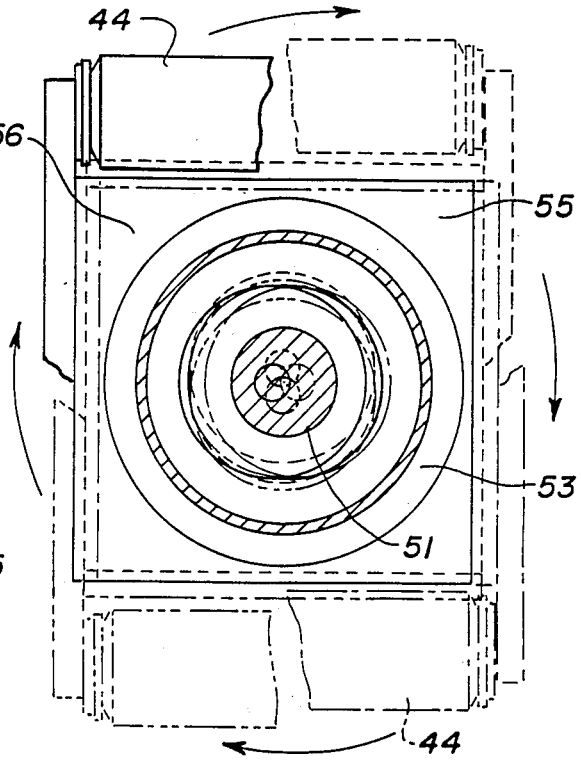
FIG. 8 is a schematic operational view of the sanding pad depicted in FIG. 7 with the oscillating motion of the pad as induced by the eccentric mounting thereof on the driven shaft of the vibrating mechanism being shown in sequence from one quadrant to the next as indicated by the arrows.

The first sanding head 20 is orbited by the first oscillatory mechanism 60 to move the sander elements 40 over the upper surface of the work piece W with a circular motion while the second oscillating mechanism 62 vibrates the sanding belts 42 in a significantly higher frequency than that induced by the first oscillating mechanism 60. To assist in an understanding of the operation of the first oscillating mechanism 60, reference can be had to the schematic view of FIG. 9 wherein the motion of the subframe 24 and a representative sander element 40 relative to the main frame 12 can be seen in phantom. In this manner, the sanding machine 10 imitates the hand sanding operation utilizing a vibratory hand sander. The work piece W passes from the first sanding head 20 to the second sanding head 22 where a second sanding operation is completed. As best seen in FIG. 4, the sander elements 40 on the second sanding head 22 are staggered with respect to the location of the sander elements 40 on the first sanding head 20, such that the sander elements 40 on the second sanding head 22 are aligned with the spaces between the respective sander elements 40 on the first sanding head 20. Accordingly, the second sanding head 22 provides a uniform sanding treatment to the work piece W and places a fine finish on the upper surface of the work piece W with only one pass through the machine 10. The sanding machine 10 can also be provided with a conventional dust collection mechanism (not shown) to extract dust from the sanding belts 42 and from within the machine 10 and transport the dust to a location remote from the sanding machine. To facilitate the removal of dust from the belts, an air bar 81, representatively depicted in FIG. 1, is positioned to blow dust off the sanding belts 42 to increase their operative life.

When replacement of the sanding belts 42 is deemed necessary, the operation of the sander 10 is shut down by cutting power to the individual electric motors 17,29,48 and 64. The movable frame support 75 can be unlatched and rotated about its hinge axis to expose the respective sanding head 20,22. A relaxing of the pneumatic tensioning mechanism 45, as shown in phantom in FIG. 5, removes the tension from the sanding belts 42 and permits the individual belts 42 to be removed from the respective sanding heads 20,22 through the left side of the machine passing through the opening formed by the removed support member 75. Following replacement of the sanding belts 42, the tensioning mechanism 45 can be reactivated, the movable frame support 75 reclamped and latched into supportive engagement with the left gearbox 26 and the machine 10 returned to a sanding operation.

Figure 10:
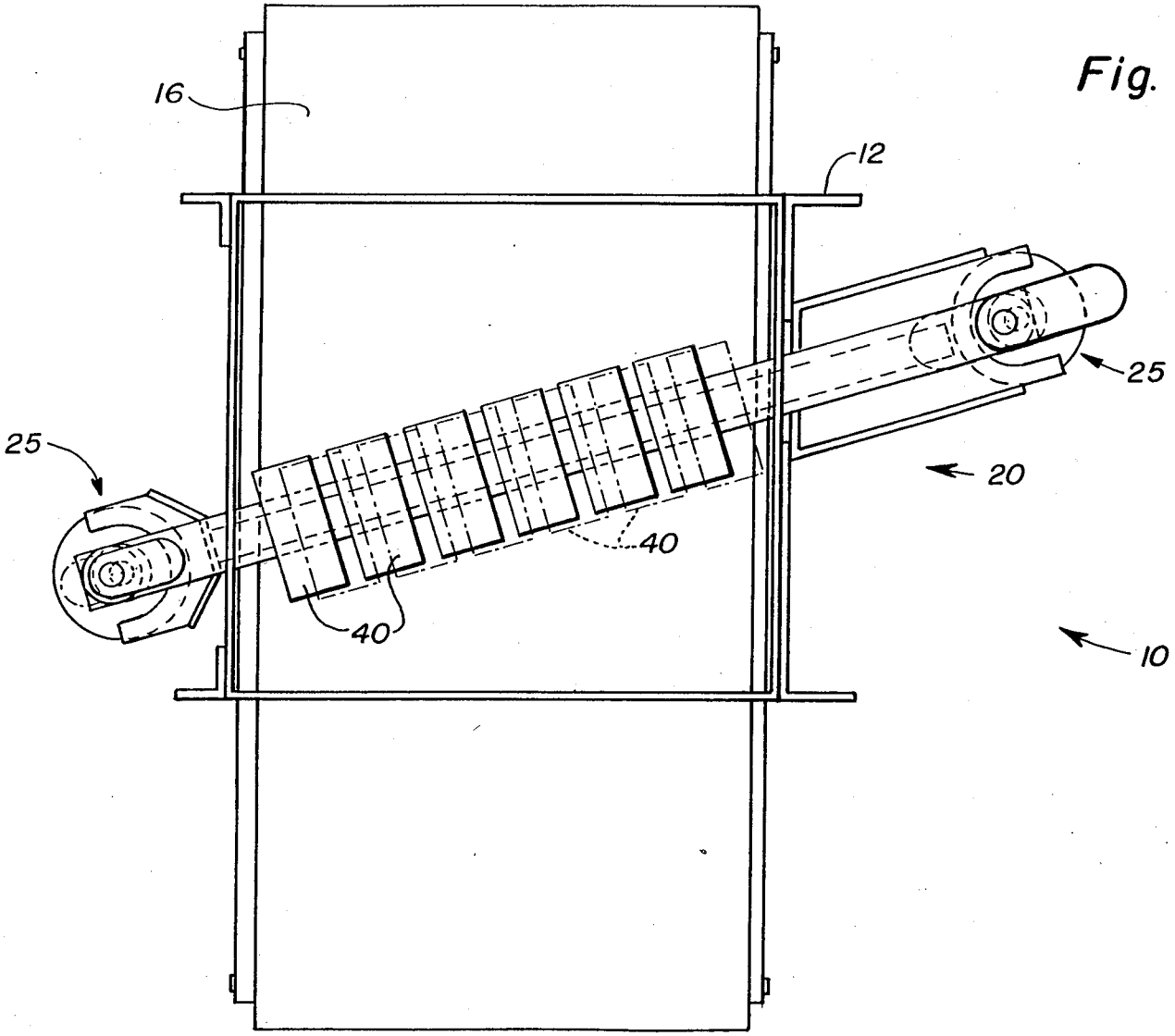
FIG. 10 is a schematic top plan view of an alternative embodiment of the sanding machine with a single sanding head turned obliquely to the direction of travel of the work piece on the conveyor.

Alternative embodiments of the above-described sanding machine would include the inversion of one or more sanding heads to sand the bottom side of work pieces run through the machine. Proper arrangement of individual upright and inverted sanding heads could provide a sanding machine to sand both the upper and lower surfaces of a work piece with only one pass through the machine. A further alternative embodiment can be seen in FIG. 10. The sanding head 20 is turned diagonally to the line of travel of the work piece on the conveyor 16. The angular relationship of the sanding head 20 to the frame 12 is such that adjacent individual sanding elements 40 overlap from the perspective of the work piece on the conveyor 16 so that no gap between the sanding elements 40 is presented to the work piece. This specific configuration would eliminate the need to have double sanding heads. As noted above, an inverted oblique sanding head 20 could also be provided to sand the lower side of the work piece. Operationally, the obliquely mounted sanding head 20 would function as described above.

It will be understood that changes in the details, materials, steps and arrangement of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly, as well as in the specific form shown.

Having thus described the invention, what is claimed is:

1. A sanding machine comprising:

a main frame;

a generally horizontal work table mounted on said frame to support work pieces thereon for movement along a first direction;

a subframe movably supported by said main frame for orbital movement relative to said work table;

rotatable sanding means supported by said subframe and movable therewith, said sanding means including a plurality of sander elements spaced apart along a second direction and being operable to engage work pieces on said work table and sand the surface thereof while being orbitally moved with said subframe;

vibrating means operatively engaged with each said sanding element for individual vibration thereof at a frequency greater than said orbital movement while being orbitally moved with said subframe, the operation of each said vibrating means being timed so that the vibratory movement of adjacent sander elements is opposed to one another; and drive means for operatively powering each said vibrating means, the orbital movement of said subframe, and the rotation of said sanding means.

2. The sanding machine of claim 1 wherein each sander element includes an endless sanding belt rotatably entrained around vertically spaced rollers and slidably engaged with a pad positioned proximate to said work table.

3. The sanding machine of claim 2 wherein said vibrating means is operatively engaged with the corresponding said pad to effect a vibration of said sanding belt when engaged with said work piece.

4. The sanding machine of claim 3 wherein each said vibrating means includes a rotatably driven shaft, the corresponding said pad being eccentrically mounted on said driven shaft by a bearing to permit said driven shaft to rotate relative to said corresponding pad and effect a vibration thereof.

5. The sanding machine of claim 4 wherein said subframe is connected to a crank mechanism for effecting the reciprocal movement thereof.

6. The sanding machine of claim 5 wherein said crank mechanism is cantilevered from one end thereof affixed to said main frame, an opposing end of said crank mechanism being engageable with a movable support hingedly connected to said main frame, said movable support facilitating the removal and replacement of said sanding belts.

7. The sanding machine of claim 6 wherein each said sander element further includes a tensioning mechanism cooperable with said sanding belt to maintain tension therein and a vibration dampener engageable with said sanding belt to reduce vibration therein above the corresponding said pad.

8. The sanding machine of claim 6 wherein said work table includes a conveyor operable to move work pieces thereon along said first direction, said work table being vertically positionable to vary the distance between said conveyor and said sander elements.

9. In a sanding machine having a main frame; a conveyor rotatably mounted on said frame to move work pieces placed thereon along a first direction; rotatable sanding means supported from said main frame above said conveyor to engage and sand a surface of said work pieces; and drive means operatively powering said conveyor and said sanding means, the improvement comprising:

first oscillating means for rotatably moving said sanding means relative to said conveyor at a first oscillating frequency; and second oscillating means for rotatably moving said sanding means relative to said conveyor at a second oscillating frequency greater than said first oscillating frequency.

10. The sanding machine of claim 9 wherein said sanding means is mounted on a subframe movably supported from said main frame for a reciprocating movement relative to said conveyor by said first oscillating means at said first oscillating frequency.

11. The sanding machine of claim 10 wherein said sanding means includes a plurality of spaced apart sander elements, the spacing between said sander elements being less than the amplitude of the reciprocating movement induced by said first oscillating means.

12. The sanding machine of claim 11 wherein each said sander element includes an endless sanding belt rotatably entrained around vertically spaced rollers and slidingly engaged with a pad positioned proximate to said conveyor to present said sanding belt into engagement with said work pieces.

13. The sanding machine of claim 12 wherein said second oscillating means includes a vibrating mechanism associated with each respective said sander element to effect a vibration of each respective said pad, said vibration being transmitted to said sanding belt for engagement thereof with said working pieces.

14. The sanding machine of claim 13 wherein said second oscillating means effects an opposing vibration in adjacent sander elements.

15. The sanding machine of claim 14 wherein said first oscillating means further includes a crank mechanism rotatably driven by said drive means to effect said reciprocatory movement, said crank mechanism being cantilevered from one end thereof affixed to said main frame, the opposing end of said crank mechanism being engageable with a removable support hingedly connected to said main frame to facilitate the removal of said sanding belts from said sander elements.

16. The sanding machine of claim 15 wherein said sanding means includes first and second sets of sanding elements spaced along said first direction from one another, the sander elements of said first set being aligned with the spacing between said sander elements of said second set.

17. A sanding machine comprising:

a main frame supporting a conveyor operable to move work pieces placed thereon along a first direction;

first and second subframes movably mounted on said main frame for independent movement relative thereto;

first and second sanding means respectively mounted on said first and second subframes above said conveyor for movement therewith relative to said conveyor, said sanding means being operable to sandingly engage the upper surface of said work pieces being conveyed on said conveyor, each of said first and second sending means including a plurality of sander elements spaced along said second direction, each said sander element including an endless sanding belt rotatably entrained around vertically spaced rollers and slidingly engaged with pad positioned proximate to said conveyor to engage the respective said sanding belt with said work pieces on said conveyor;

first oscillating means operatively connected to said first and second subframes to effect a orbital movement of said firist and second sanding means, respectively, along a second direction perpendicular to said first direction at a first frequency and amplitude;

second oscillating means operatively associated with each said sander element for individually effecting a vibration of the respective said pads at a second frequency greater than said first frequency, the operation of each said second oscillating means being timed so that the vibrating movement of adjacent sander elements with respect to said second direction is opposed to one another; and drive means for operatively powering said first oscillating means, said second oscillating means, each said sanding means and said conveyor.

18. The sanding machine of claim 17 wherein the sander elements of said first sanding means are staggered with respect to the sander elements of said second sanding means.

19. The sanding machine of claim 18 wherein the amplitude of said orbital movement of said first and second subframes is greater than the spacing between said sander elements.

20. A sanding machine comprising:

a main frame supporting a conveyor operable to move work pieces placed thereon along a first direction;

a subframe mounted on said main frame and extending in a second direction obliquely oriented relative to said first direction;

a plurality of sander elements mounted on said subframe and spaced apart from one another in said second direction, each said sander element having a sanding belt rotatably mounted thereon for engaging and sanding a surface of said work pieces, the spacing of said sander elements along said second direction being such that the path of movement of adjacent sanding belts overlap each other when viewed along said first direction; and first and second oscillatory means operatively associated with said sander elements to effect movements of said sander elements at two separate frequencies, said first oscillating means rotatably orbiting said subframe at a first frequency and amplitude in a generally horizontal plane to move said sander elements simultaneously, said second oscillating means vibrating each respective sander element at a second frequency and amplitude in a timed manner to vibrate each said sander element at an opposing phase to the adjacent sander elements.

* * * * *